US009332365B2

(12) United States Patent
Pan

(10) Patent No.: US 9,332,365 B2
(45) Date of Patent: May 3, 2016

(54) STEREO DEVICE TESTING METHOD AND STEREO DEVICE TESTING SYSTEM

(71) Applicant: Primax Electronics Ltd., Neihu, Taipei (TW)

(72) Inventor: Yung-Tai Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 101 days.

(21) Appl. No.: 14/452,056

(22) Filed: Aug. 5, 2014

(65) Prior Publication Data

US 2015/0215718 A1 Jul. 30, 2015

(30) Foreign Application Priority Data

Jan. 27, 2014 (CN) ..... 2014 1 0041161

(51) Int. Cl.
*H04R 1/02* (2006.01)
*H04R 29/00* (2006.01)
*H04R 5/00* (2006.01)

(52) U.S. Cl.
CPC . *H04R 29/00* (2013.01); *H04R 5/00* (2013.01)

(58) Field of Classification Search
CPC ..... H04R 5/02; H04R 1/025
USPC ..... 381/87
See application file for complete search history.

(56) References Cited

U.S. PATENT DOCUMENTS

2012/0125085 A1* 5/2012 Wu ..... G01M 3/329 73/38

* cited by examiner

*Primary Examiner* — Simon King
(74) *Attorney, Agent, or Firm* — Kirton McConkie; Evan R. Witt

(57) ABSTRACT

A stereo device testing method includes the following steps. Firstly, a stereo device is fixed, and a gas is continuously inputted into an inner space of the stereo device. After a predetermined time period, an internal pressure value of the inner space of the stereo device is detected. By judging whether the internal pressure value is higher than or equal to a default pressure value, the tester may determine whether the stereo device is qualified or not. After the stereo device is tested, the manufacturer of the stereo device may repair the gas leakage position. Since the influence of the gas leakage condition on the resonant effect is minimized, the sound quality of the stereo device is enhanced.

15 Claims, 7 Drawing Sheets

STEREO DEVICE TESTING METHOD AND STEREO DEVICE TESTING SYSTEM

FIELD OF THE INVENTION

The present invention relates to a stereo device, and more particularly to a testing method and a testing system of a stereo device.

BACKGROUND OF THE INVENTION

With increasing development of science and technology as well as industrial and commercial prosperity, people's living standards are gradually increased and the demands on the quality of leisure lives are developed toward sophisticated levels. For example, the hearing effects of sound, the visual changes of light beams or the clarity of images are important issues of the technical development and product development. Moreover, since songs (or music) may provide the function of relaxing the listeners and eliminating stress, songs (or music) are important to the leisure lives. Consequently, a variety of stereo devices are introduced into the market in order to meet the requirements of different users. For example, high-quality stereo devices, stereo devices that produce shocked hearing effects or small-sized portable stereo devices were developed.

Regardless of which type of stereo device is used, the inner space of the stereo device may generate a resonant effect to produce sound. The operating principles of the stereo device will be simply described as follows. Firstly, electric power is supplied to a coil of the stereo device. Consequently, an electric current flows through the coil to generate an electromagnetic field. For example, the frequency of the electromagnetic field is 256 Hz. That is, the number of vibration cycles per second is 256. When an AC power with the frequency of 256 Hz is outputted from the stereo device, the number of times the electric current changes per second is 256. Consequently, the membrane and the coil within the stereo device are subjected to vibration. Due to the vibration of the membrane and the coil, the air within the inner space of the stereo device is vibrated and a resonant effect occurs. In such way, the stereo device can produce sound.

However, a portion of the air may leak out from the inner space of the stereo device. If the amount of air leaking out from the inner space of the stereo device is very large, the resonant effect of the stereo device is adversely affected and the quality of the stereo device is deteriorated.

Therefore, there is a need of providing a stereo device testing method and a stereo device testing system in order to detect a gas leakage condition of the stereo device.

SUMMARY OF THE INVENTION

An object of the present invention provides a stereo device testing method for detecting a gas leakage condition of a stereo device.

Another object of the present invention provides a stereo device testing system for detecting a gas leakage condition of a stereo device.

In accordance with an aspect of the present invention, there is provided a stereo device testing method for detecting a gas leakage condition of a stereo device. The stereo device testing method includes the following steps. Firstly, the stereo device is fixed, and a gas is continuously inputted into an inner space of the stereo device. Then, an internal pressure value of the inner space of the stereo device is detected after a predetermined time period. By judging whether the internal pressure value is higher than or equal to a default pressure value, the tester may determine whether the stereo device is qualified or not. If the internal pressure value is higher than or equal to the default pressure value, the stereo device is qualified. Whereas, if the internal pressure value is lower than the default pressure value, the stereo device is unqualified.

In accordance with another aspect of the present invention, there is provided a stereo device testing system for detecting a gas leakage condition of a stereo device. The stereo device testing system includes a testing fixture, a gas pressure supply module, a gas pressure detector, and a controlling unit. The stereo device is supported and fixed on the testing fixture. The gas pressure supply module is connected with the testing fixture. A gas is continuously provided from the gas pressure supply module to an inner space of the stereo device. The gas pressure detector is connected with the testing fixture. An internal pressure value of the inner space is detected by the gas pressure detector. The controlling unit is connected with the gas pressure detector. A default pressure value is stored in the controlling unit. After a predetermined time period, the controlling unit compares the internal pressure value with the default pressure value, thereby judging whether the stereo device is qualified or not. If the internal pressure value is higher than or equal to the default pressure value, the controlling unit judges that the stereo device is qualified. If the internal pressure value is lower than the default pressure value, the controlling unit judges that stereo device is unqualified.

In accordance with another aspect of the present invention, there is provided a stereo device testing method for detecting a gas leakage condition of a stereo device. The stereo device testing method includes the following steps. Firstly, the stereo device is fixed, and a gas is continuously inputted into an inner space of the stereo device. A gas temperature of the gas is higher than a room temperature, or the gas temperature of the gas is lower than the room temperature. Then, a special color zone which is formed by the gas leaked out from the inner space is observed according to a temperature sensing technology. Then, by judging whether a color of the special color zone is within a standard color range, the tester determines whether the stereo device is qualified or not. If the color of the special color zone is within the standard color range, the stereo device is qualified. Whereas, if the color of the special color zone is not within the standard color range, the stereo device is unqualified.

In accordance with another aspect of the present invention, there is provided a stereo device testing system for detecting a gas leakage condition of a stereo device. The stereo device testing system includes a testing fixture, a gas pressure supply module, a temperature sensor, and a controlling unit. The stereo device is supported and fixed on the testing fixture. The gas pressure supply module is connected with the testing fixture. A gas is continuously provided from the gas pressure supply module to an inner space of the stereo device. The temperature sensor is located near the testing fixture and detects whether there is a special color zone around the stereo device. The controlling unit is connected with the temperature sensor. A standard color range is previously stored in the controlling unit. The controlling unit judges whether a color of the special color zone is within the standard color range, thereby determining whether the stereo device is qualified or not. If the color of the special color zone is within the standard color range, the controlling unit judges that the stereo device is qualified. If the color of the special color zone is not within the standard color range, the controlling unit judges that the stereo device is unqualified.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks of the conventional technology, the present invention provides a stereo device testing method and a stereo device testing system.

Figure 1:
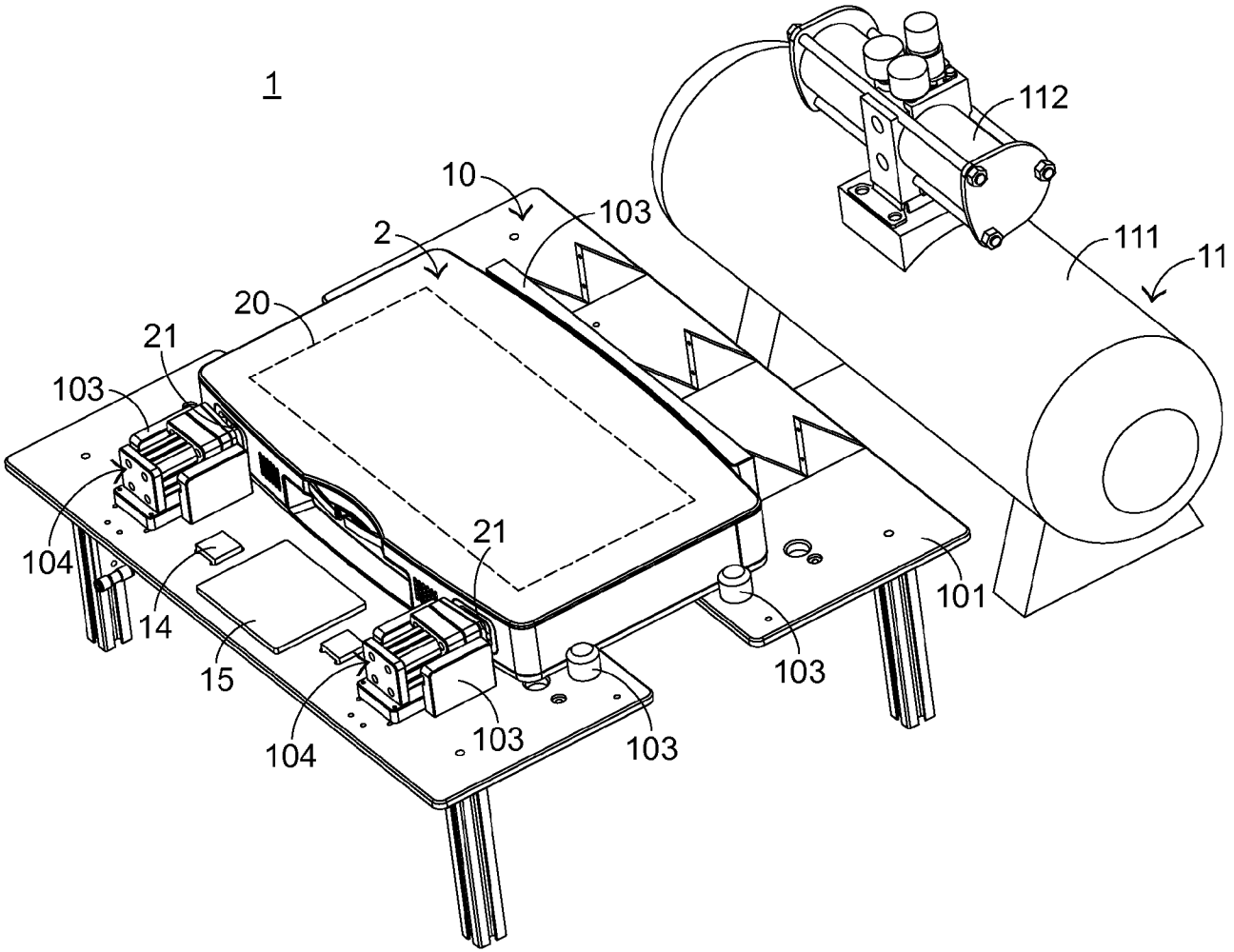
FIG. 1 is a schematic perspective view illustrating a stereo device testing system according to a first embodiment of the present invention.
Figure 2:
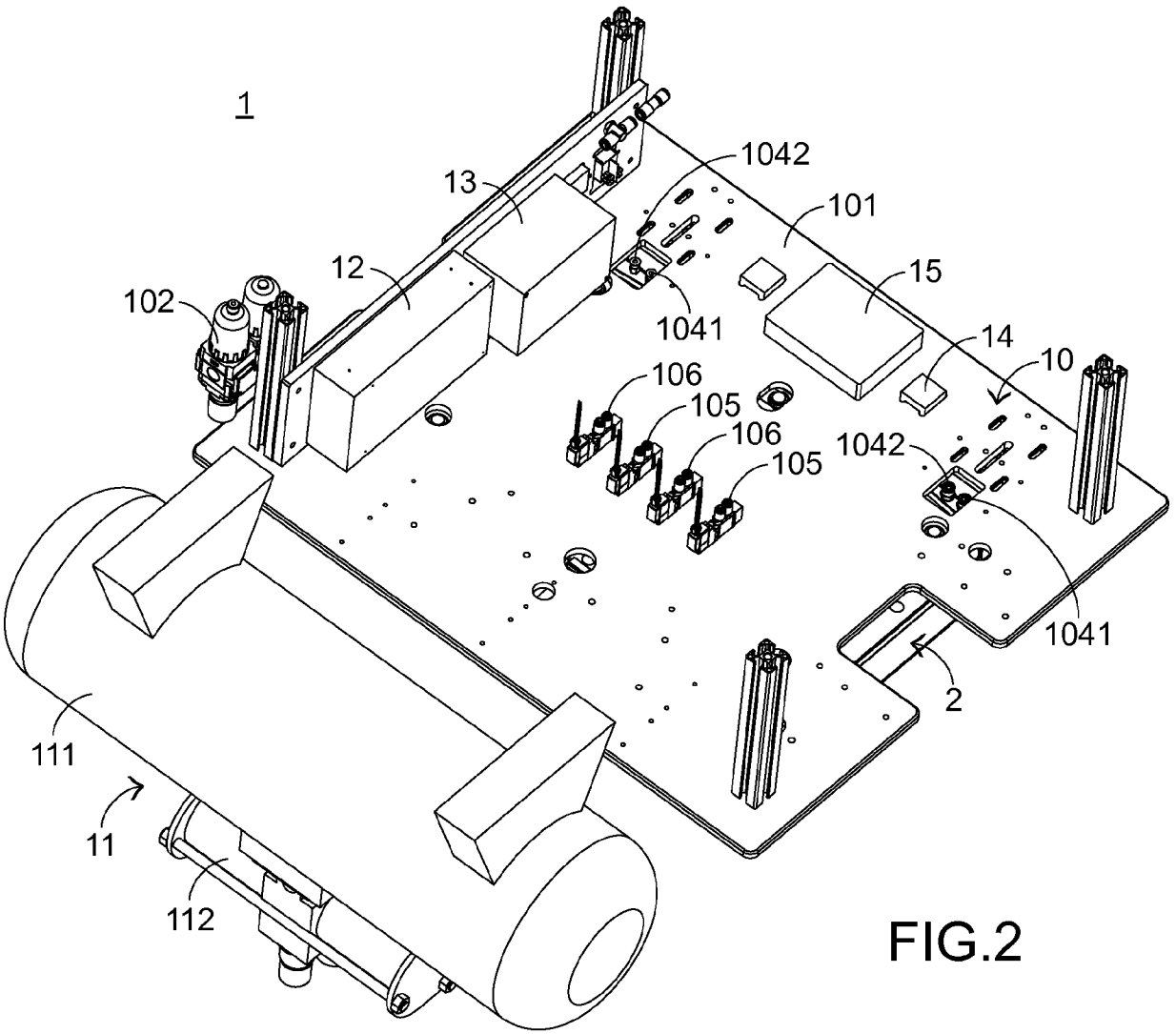
FIG. 2 is a schematic bottom view illustrating the stereo device testing system according to the first embodiment of the present invention.

Hereinafter, a stereo device testing system according to a first embodiment of the present invention will be illustrated with reference to FIGS. 1 and 2. FIG. 1 is a schematic perspective view illustrating a stereo device testing system according to the first embodiment of the present invention. FIG. 2 is a schematic bottom view illustrating the stereo device testing system according to the first embodiment of the present invention. The stereo device testing system 1 comprises a testing fixture 10, a gas pressure supply module 11, a gas pressure detector 12, a controlling unit 13, a first display device 14, and a second display device 15. The testing fixture 10 is used for supporting a stereo device 2 and fixing the stereo device 2 thereon. The gas pressure supply module 11 is connected with the testing fixture 10 through a pipe (not shown). Moreover, the gas pressure supply module 11 is used for continuously providing a gas to an inner space 20 of the stereo device 2. The gas pressure detector 12 is connected with the testing fixture 10 through a pipe (not shown). Moreover, the gas pressure detector 12 is used for detecting an internal pressure value of the inner space 20 of the stereo device 2. The controlling unit 13 is disposed on the testing fixture 10 and connected with the gas pressure detector 12. A default pressure value is stored in the controlling unit 13. After a predetermined time period, the controlling unit 13 compares the internal pressure value with the default pressure value. According to the comparing result, the controlling unit 13 whether the stereo device 2 passes the test or not. The predetermined time period may be determined according to the practical requirements. The first display device 14 is disposed on the testing fixture 10 and connected with the gas pressure detector 12. Moreover, the internal pressure value is shown on the first display device 14. The second display device 15 is disposed on the testing fixture 10 and connected with the controlling unit 13. A pass test message or a failed test message may be shown on the second display device 15. In this embodiment, the gas pressure supply module 12 is a gas pressure gauge, the controlling unit 13 is a programmable logic controller (PLC), and the first display device 14 and the second display device 15 are both display screens.

It is noted that, in FIGS. 1 and 2, the testing fixture 10 and the gas pressure supply module 11 are connected with each other and the testing fixture 10 and the gas pressure detector 12 are connected with each other through pipes. For clarification and brevity, the pipes are not shown in FIGS. 1 and 2.

Please refer to FIGS. 1 and 2 again. The testing fixture 10 comprises a bracket body 101, a master pressure pump 102, plural fixing elements 103, plural sealing elements 104, plural first switch elements 105, and plural second switch elements 106. The bracket body 101 is used for supporting the stereo device 2. The master pressure pump 102 is connected with the gas pressure supply module 11 through a pipe (not shown) in order to receive the gas from the gas pressure supply module 11. The plural fixing elements 103 are disposed on the bracket body 101 for fixing the stereo device 2 on the bracket body 101. The plural sealing elements 104 are aligned with plural communication holes 21 of the stereo device 2, respectively. The plural sealing elements 104 are disposed on the bracket body 101 and connected with the gas pressure detector 12. Moreover, the plural sealing elements 104 are inserted into the plural communication holes 21 for closing the plural communication holes 21. Each of the plural sealing elements 104 comprises a gas inlet 1041 and a gas outlet 1042. The gas inlet 1041 is formed in a bottom of the sealing element 104. The gas outlet 1042 is formed in the bottom of the sealing element 104, and located beside the gas inlet 1041. Through the gas inlet 1041, the gas may be introduced from the master pressure pump 102 into the inner space 20 of the stereo device 2. Through the gas outlet 1042, the gas exhausted from the inner space 20 of the stereo device 2 is introduced into the gas pressure detector 12.

The plural first switch elements 105 are connected with the master pressure pump 102 and the plural gas inlets 1041 through pipes (not shown). When the first switch element 105 is turned on, the gas is introduced into the inner space 20 through the corresponding gas inlet 1041. Similarly, the plural second switch elements 106 are connected with the gas pressure detector 12 and the plural gas outlets 1042 through pipes (not shown). When the second switch element 106 is turned on, the gas is introduced into the gas pressure detector 12 through the corresponding gas outlet 1042. The gas pressure supply module 11 comprises a gas source 111 and a pressure booster 112. The gas source 111 is used for continuously providing the gas. The pressure booster 112 is connected with the gas source 111 for stabilizing a gas pressure value of the gas or increasing the gas pressure value and transferring the gas to the master pressure pump 102 of the testing fixture 10. The pressure booster 112 may increase the gas pressure value of the gas to the pressure higher than the normal atmospheric pressure (e.g. 1 Pa). In this embodiment, the plural fixing elements 103 comprises plural fixing posts and plural fixing plates, and the plural first switch elements 105 and the plural second switch elements 106 are all solenoid valves.

Figure 3:
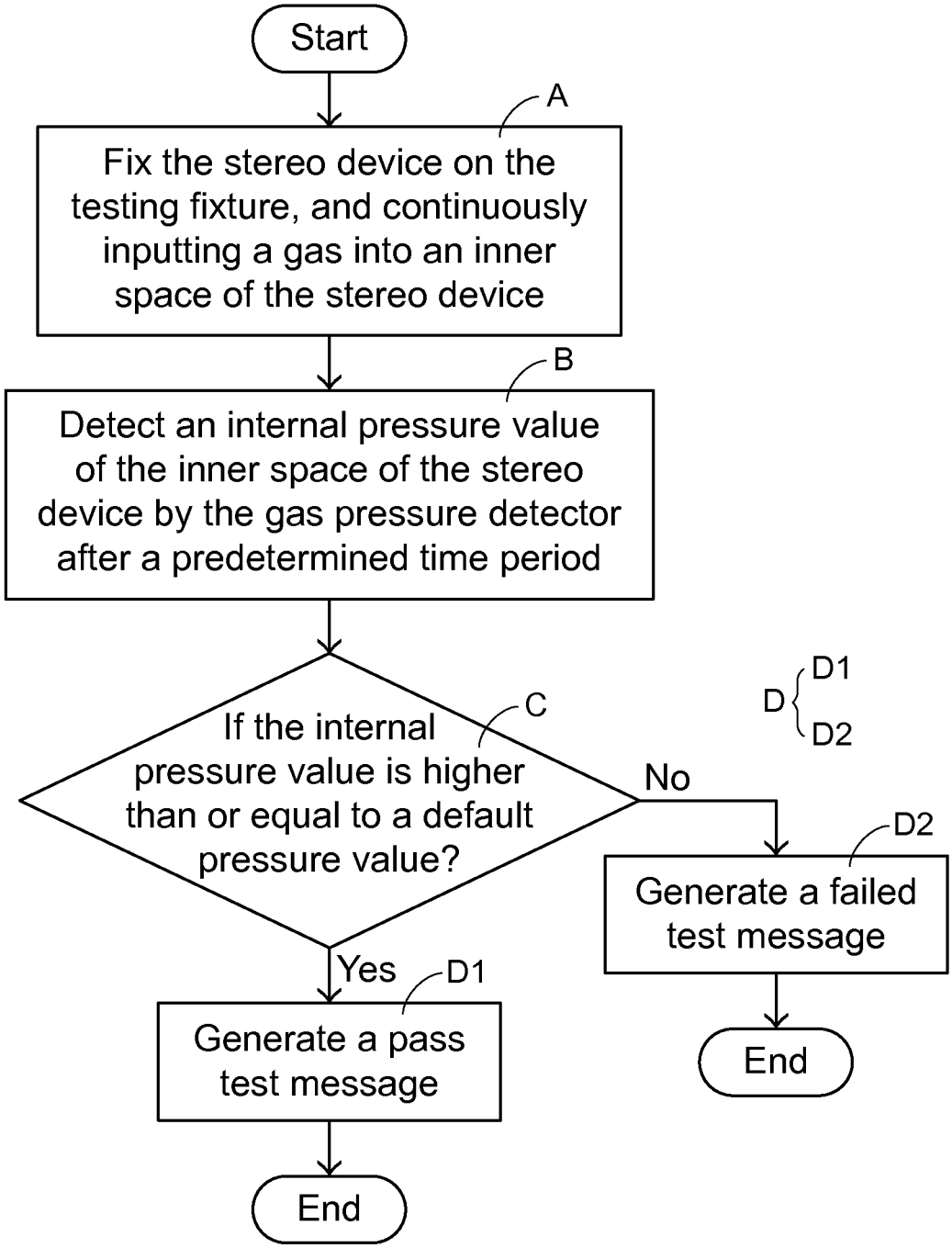
FIG. 3 is a flowchart illustrating a stereo device testing method according to a first embodiment of the present invention.

Hereinafter, a stereo device testing method according to a first embodiment of the present invention will be illustrated with reference to FIG. 3. FIG. 3 is a flowchart illustrating a stereo device testing method according to the first embodiment of the present invention. The stereo device testing method comprises the following steps. In the step A, the stereo device is fixed on the testing fixture, and a gas is continuously inputted into an inner space of the stereo device. In the step B, an internal pressure value of the inner space of the stereo device is detected by the gas pressure detector after a predetermined time period. The step C judges whether the internal pressure value is higher than or equal to a default pressure value, thereby determining whether the stereo device is qualified or not. In the step D, a pass test message or a failed test message is generated according to a result of comparing the internal pressure value with the default pressure value.

The step A comprises sub-steps A1~A3. In the sub-step A1, the stereo device is fixed on the testing fixture. In the sub-step A2, the pressure booster is used to stabilize or increase a gas pressure value of the gas. In the sub-step A3, the gas is continuously inputted into the inner space of the stereo device. The step D comprises the sub-steps D1 and D2. In the sub-step D1, the pass test message is generated. In the sub-step D2, the failed test message is generated. In the step C, if the internal pressure value is higher than or equal to the default pressure value, the stereo device is qualified to pass the test, and then the sub-step D1 is performed. In the step C, if the internal pressure value is lower than the default pressure value, the stereo device is unqualified, and then the sub-step D2 is performed.

The operations of the stereo device testing method will be illustrated in more details as follows. Please refer to FIGS. 1~3. Firstly, the step A is performed. The stereo device 2 is placed on the bracket body 101 of the testing fixture 10, and the stereo device 2 is fixed on the bracket body 101 by the plural fixing elements 103. Moreover, the plural sealing elements 104 are aligned with plural communication holes 21 of the stereo device 2, respectively. Then, the plural sealing elements 104 are driven to be inserted into the plural communication holes 21. Consequently, the plural communication holes 21 are closed by the plural sealing elements 104. That is, the sub-step A1 is performed. Then, the gas source 111 is turned on to provide the gas. Moreover, the pressure booster 112 is used to stabilize or increase the gas pressure value of the gas. That is, the sub-step A2 is performed. Afterwards, the gas of the gas pressure supply module 11 is transferred to the master pressure pump 102. The plural first switch elements 105 are turned on. Consequently, the gas from the master pressure pump 102 is introduced into the inner space 20 of the stereo device 2 through the plural gas inlets 1041. That is, the sub-step A3 is performed.

After the gas has been continuously introduced into the inner space 20 for the predetermined time period (e.g. three minutes), the plural second switch element 106 are turned on by the controlling unit 13. Consequently, the gas within the inner space 20 is introduced into the gas pressure detector 12 through the plural gas outlets 1042. After the gas is detected by the pressure detector 12, the internal pressure value of the inner space 20 is acquired by the pressure detector 12. That is, the step B is performed. At the same time, the internal pressure value is transmitted from the pressure detector 12 to the controlling unit 13 and the first display device 14. Consequently, the internal pressure value is shown on the first display device 14.

Then, the controlling unit 13 compares the internal pressure value with the default pressure value in order to judge whether the stereo device 2 is qualified or not. That is, the step C is performed. If the internal pressure value is higher than or equal to the default pressure value, the controlling unit 13 judges that the stereo device 2 is qualified, and the pass test message is shown on the second display device 15. That is, the sub-step D1 is performed. On the other hand, if the internal pressure value is lower than the default pressure value, the controlling unit 13 judges that the stereo device 2 is unqualified, and the failed test message is shown on the second display device 15. That is, the sub-step D2 is performed. After the step D is completed, the plural sealing elements 104 are driven again to be moved away from the plural communication holes 21. Consequently, the stereo device 2 is no longer in the sealed state. After the stereo device 2 is removed from the testing fixture 10, the testing process of the stereo device 2 is completed. Then, a next stereo device may be tested by the above testing method.

As mentioned above, the gas pressure supply module 11 of this embodiment comprises the pressure booster 112 for stabilizing or increasing the gas pressure value of the gas. In case that the gas provided by the gas source is very stable and the gas pressure of the gas is higher than the normal atmospheric pressure, the pressure booster may be omitted from the gas pressure supply module. Under this circumstance, the gas is directly transferred from the gas source to the testing fixture.

Figure 4:
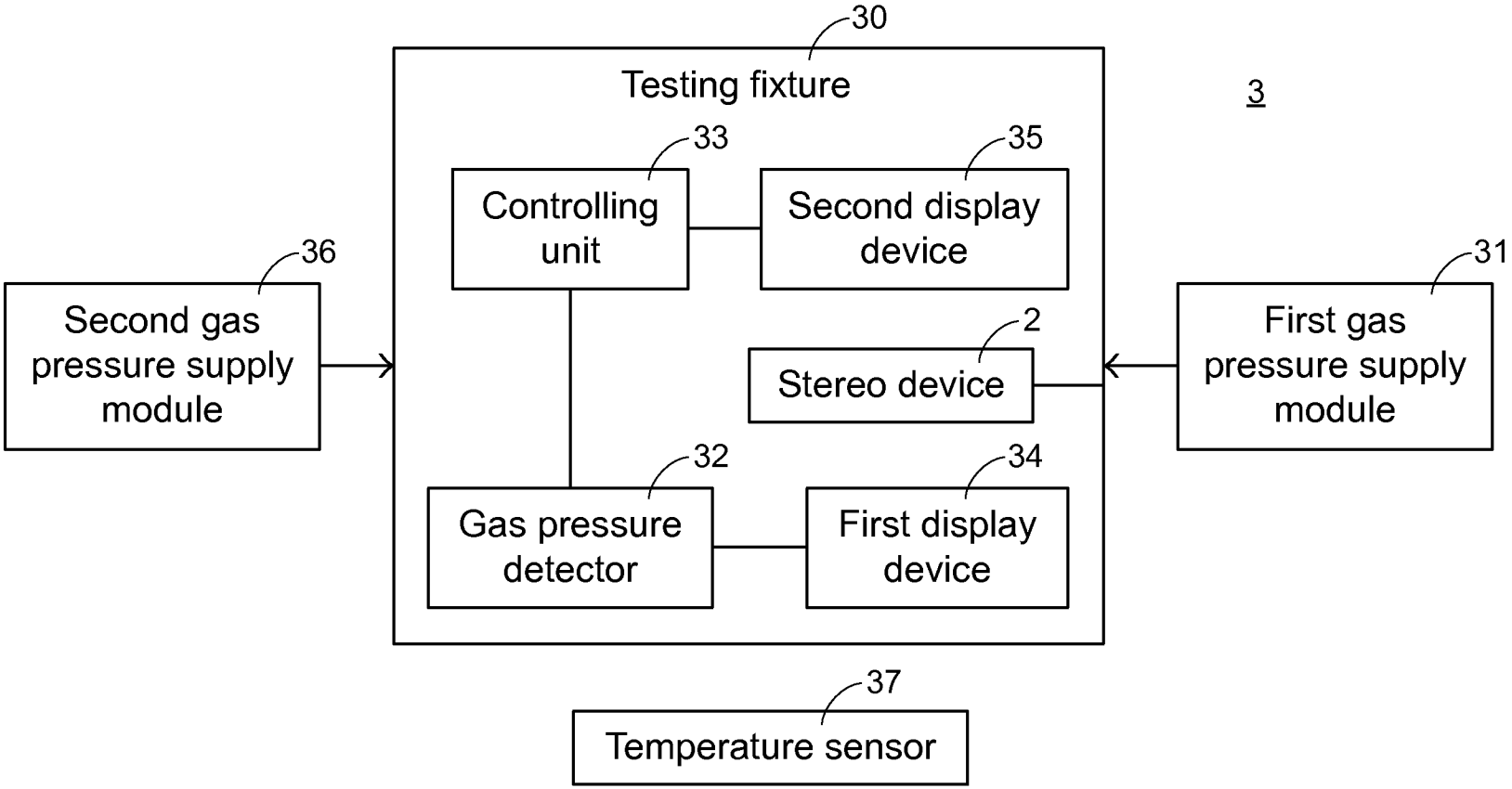
FIG. 4 is a schematic functional block diagram illustrating a stereo device testing system according to a second embodiment of the present invention.

The present invention further provides a second embodiment, which is distinguished from the first embodiment. Hereinafter, the structure of a stereo device testing system according to the second embodiment of the present invention will be illustrated with reference to FIG. 4. FIG. 4 is a schematic functional block diagram illustrating a stereo device testing system according to the second embodiment of the present invention. The stereo device testing system 3 comprises a testing fixture 30, a first gas pressure supply module 31, a gas pressure detector 32, a controlling unit 33, a first display device 34, and a second display device 35, a second gas pressure supply module 36, and a temperature sensor 37. The first gas pressure supply module 31 is used for providing a first gas. The structures and the operations of the testing fixture 30, the first gas pressure supply module 31, the gas pressure detector 32, the controlling unit 33, the first display device 34 and the second display device 35 of this embodiment are similar to those of the stereo device testing system of the first embodiment, and are not redundantly described herein. In comparison with the first embodiment, the stereo device testing system 3 of this embodiment further comprises the second gas pressure supply module 36 and the temperature sensor 37. The second gas pressure supply module 36 is a second gas source for providing a second gas. The temperature sensor 37 is located near the testing fixture 30 for detecting whether there is a special color zone around the stereo device 2. If there is the special color zone around the stereo device 2, the special color zone is recorded as a gas leakage position of the stereo device 2. In this embodiment, the temperature sensor 37 is an infrared camera.

Figure 5:
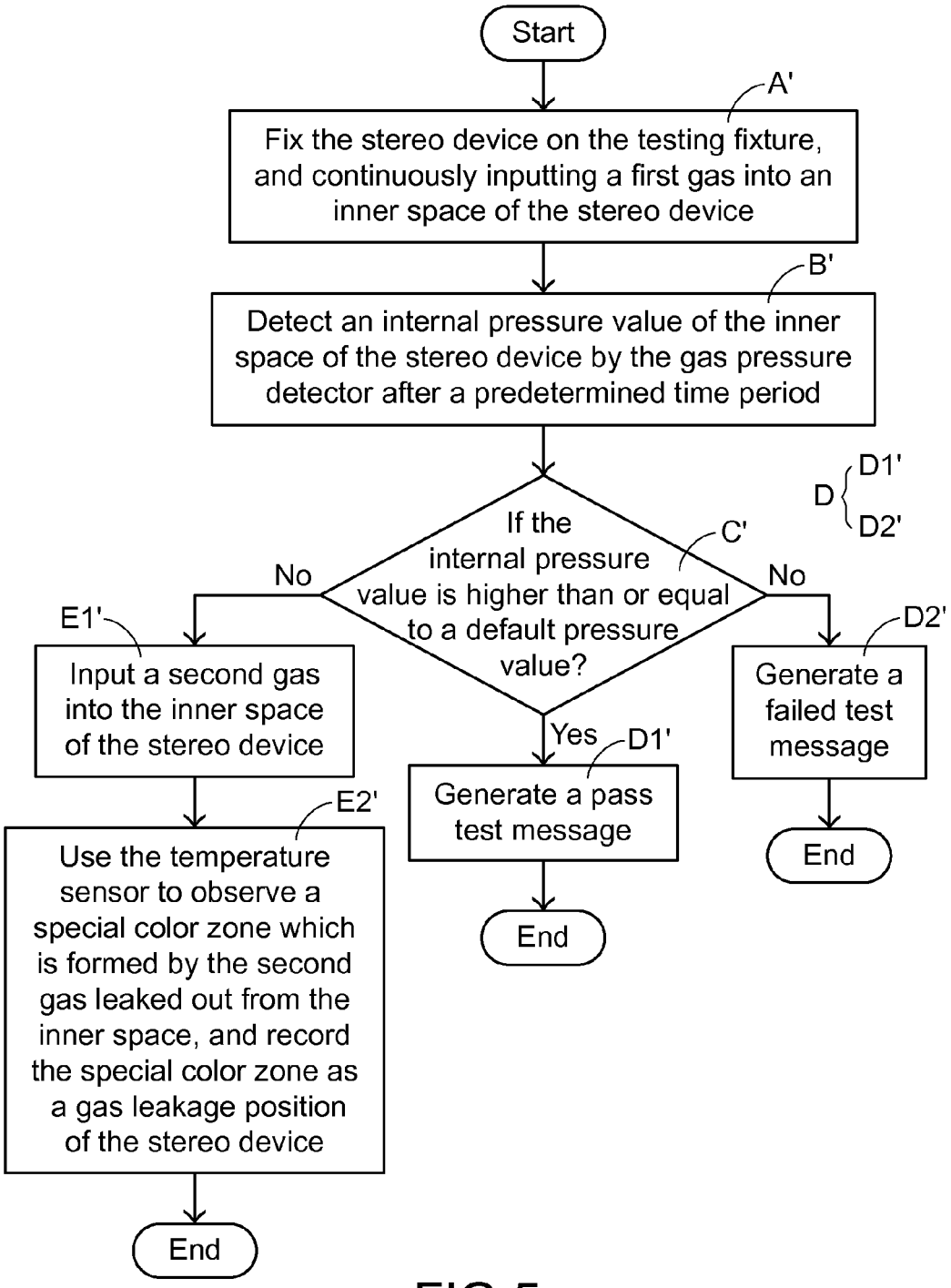
FIG. 5 is a flowchart illustrating a stereo device testing method according to a second embodiment of the present invention.

Hereinafter, a stereo device testing method according to a second embodiment of the present invention will be illustrated with reference to FIG. 5. FIG. 5 is a flowchart illustrating a stereo device testing method according to the second embodiment of the present invention. The stereo device testing method comprises the following steps. In the step A', the stereo device is fixed on the testing fixture, and a first gas is continuously inputted into an inner space of the stereo device. In the step B', an internal pressure value of the inner space of the stereo device is detected by the gas pressure detector after a predetermined time period. The step C' judges whether the internal pressure value is higher than or equal to a default pressure value, thereby determining whether the stereo device is qualified or not. In the step D', a pass test message or a failed test message is generated according to a result of comparing the internal pressure value with the default pressure value. In the step E1', a second gas is inputted into the inner space of the stereo device. In the step E2', a special color zone which is formed by the second gas leaked out from the inner space is observed by the temperature sensor, and the special color zone is recorded as a gas leakage position of the stereo device.

The steps A'~D' of the stereo device testing method of this embodiment are similar to the steps A~D of the stereo device testing method of the first embodiment, and are not redundantly described herein. In comparison with the stereo device testing method of the first embodiment, the stereo device testing method of this embodiment further comprises the sub-steps E1' and E2'. Please refer to FIGS. 4 and 5. After the steps A'~B' are performed, if the controlling unit 33 judges that the stereo device 2 is unqualified in the step C', the failed test message is controlled to be shown on the second display device 35. That is, the sub-step D2' is performed. At the same time, the second gas in inputted from the second gas pressure supply module 36 to the inner space 20 of the stereo device 2. That is, the sub-step E1' is performed. In this embodiment, the second gas is a high temperature gas, and the temperature of the second gas is higher than the room temperature. The room temperature is the temperature at the position of the stereo device 2. Alternatively, in some other embodiments, the second gas is a low temperature gas, and the temperature of the second gas is lower than the room temperature.

After a certain time period, the second gas is leaked out from the inner space 20. Since the temperature of the second gas is higher than the room temperature, a special color zone may be formed around the stereo device 2 by the second gas which is leaked out, and the special color zone may be observed by the temperature sensor 37. The color of the special color zone is a warm color. Then, the special color zone is recorded as the gas leakage position of the stereo device 2 by the temperature sensor 37. That is, the sub-step E2' is performed. After the sub-step E1' and the sub-step E2' are performed, the manufacturer of the stereo device 2 may repair the gas leakage position. Consequently, the stereo device 2 may produce a good resonant effect, and the sound quality of the stereo device 2 will be enhanced.

Figure 6:
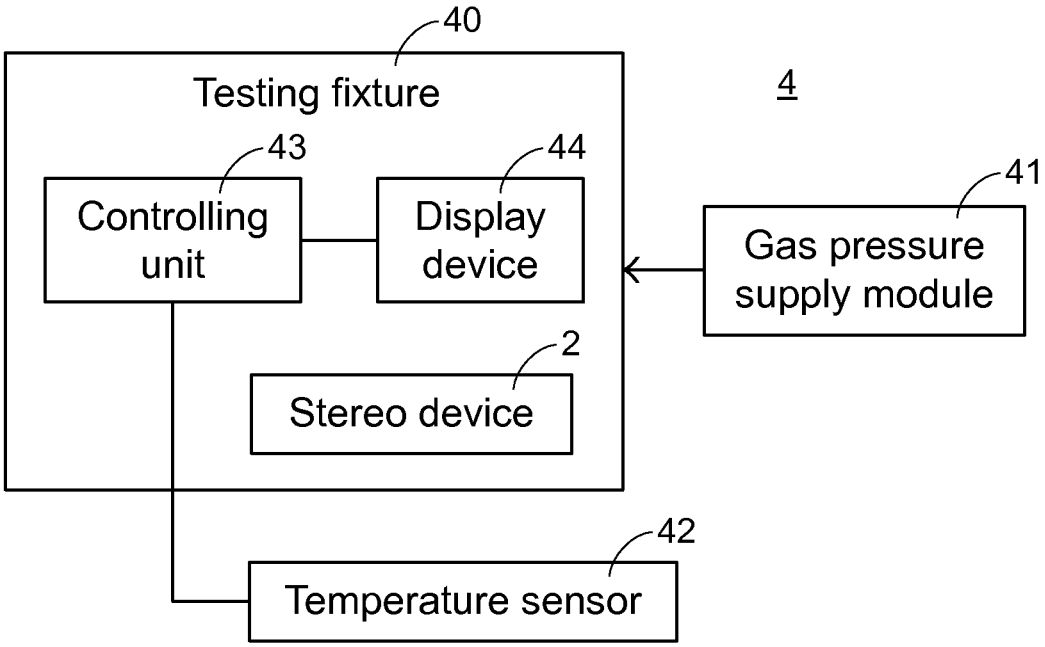
FIG. 6 is a schematic functional block diagram illustrating a stereo device testing system according to a third embodiment of the present invention.

The present invention further provides a third embodiment, which is distinguished from the first embodiment. Hereinafter, the structure of a stereo device testing system according to the third embodiment of the present invention will be illustrated with reference to FIG. 6. FIG. 6 is a schematic functional block diagram illustrating a stereo device testing system according to the third embodiment of the present invention. The stereo device testing system 4 comprises a testing fixture 40, a gas pressure supply module 41, a temperature sensor 42, a controlling unit 43, and a display device 44. The testing fixture 40 is used for supporting a stereo device 2 and fixing the stereo device 2 thereon. The gas pressure supply module 41 is connected with the testing fixture 40 for continuously providing a gas to an inner space 20 of the stereo device 2. In this embodiment, the gas is a low temperature gas, and the temperature of the gas is lower than the room temperature. The temperature sensor 42 is located near the testing fixture 40 for detecting whether there is a special color zone around the stereo device 2. The controlling unit 43 is connected with the temperature sensor 42. Moreover, a standard color range is previously stored in the controlling unit 43. By judging whether the color of the special color zone is within the standard color range, the controlling unit 43 determines whether the stereo device 2 is qualified or not. The display device 44 is disposed on the testing fixture 40 and connected with the controlling unit 43. A pass test message or a failed test message may be shown on the display device 44. The structures and the operations of the testing fixture 40 are similar to the testing fixture 10 of the stereo device testing system of the first embodiment, and are not redundantly described herein. In this embodiment, the gas pressure supply module 41 is a gas source.

Figure 7:
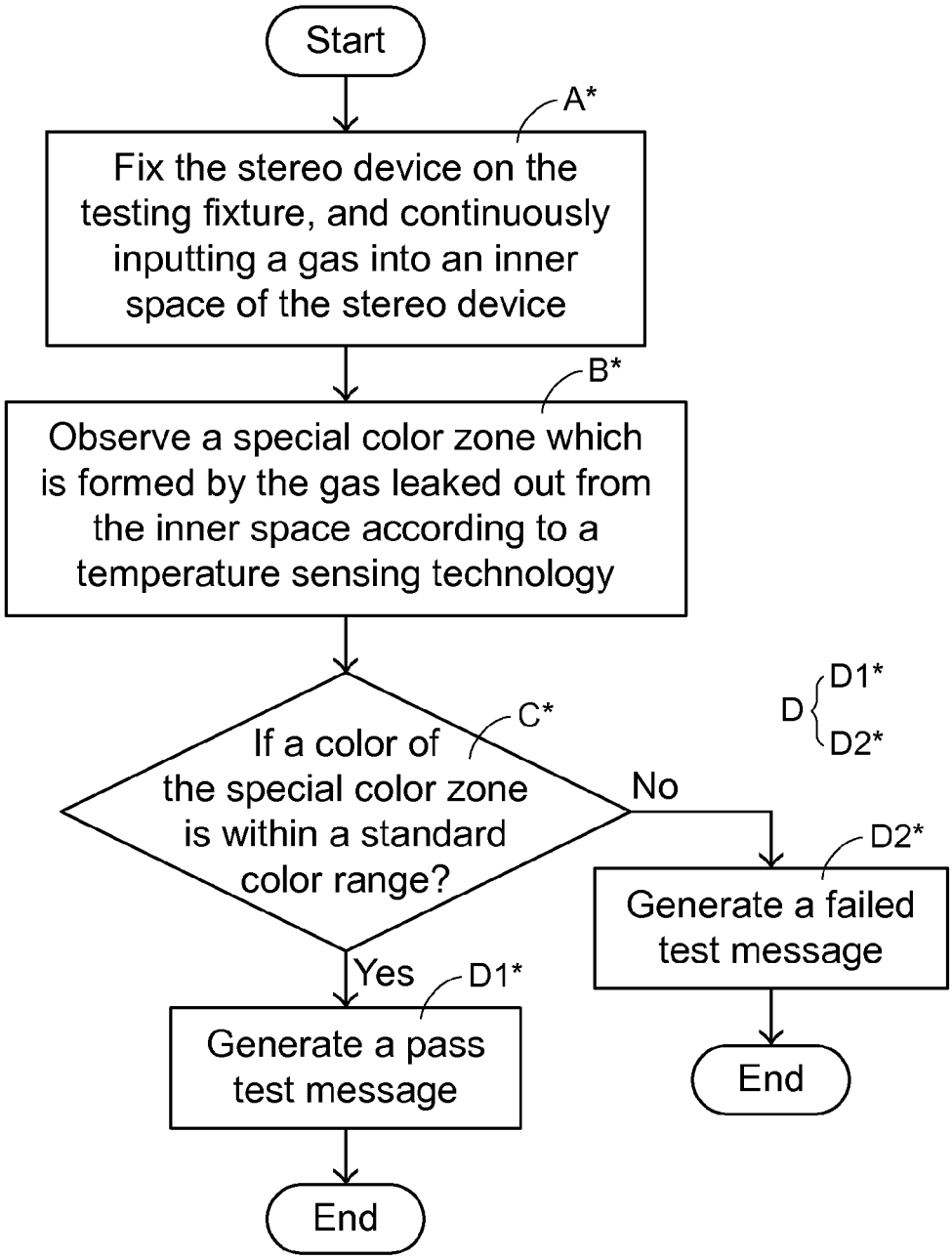
FIG. 7 is a flowchart illustrating a stereo device testing method according to the third embodiment of the present invention.

Hereinafter, a stereo device testing method according to a third embodiment of the present invention will be illustrated with reference to FIG. 7. FIG. 7 is a flowchart illustrating a stereo device testing method according to the third embodiment of the present invention. The stereo device testing method comprises the following steps. In the step A*, the stereo device is fixed on the testing fixture, and a gas is continuously inputted into an inner space of the stereo device. In the step B*, a special color zone which is formed by the gas leaked out from the inner space is observed according to a temperature sensing technology. The step C* judges whether a color of the special color zone is within a standard color range, thereby determining whether the stereo device is qualified or not. In the step D*, a pass test message or a failed test message is generated according to a result of judging whether the color of the special color zone is within the standard color range.

The step A* comprises sub-steps A1* and A2*. In the sub-step A1*, the stereo device is fixed on the testing fixture. In the sub-step A2*, the gas is continuously inputted into the inner space of the stereo device. The step D* comprises the sub-steps D1* and D2*. In the sub-step D1*, the pass test message is generated. In the sub-step D2*, the failed test message is generated. In the step C*, if the color of the special color zone is within the standard color range, the stereo device is qualified to pass the test, and then the sub-step D1* is performed. In the step C*, if the color of the special color zone is not within the standard color range, the stereo device is unqualified, and then the sub-step D2* is performed.

The operations of the stereo device testing method will be illustrated in more details as follows. Please refer to FIGS. 6 and 7. Firstly, the step A* is performed. The stereo device 2 is placed on the testing fixture 40, and the stereo device 2 is fixed on the testing fixture 40. Then, the stereo device 2 is sealed, so that the stereo device 2 is in a sealed state. That is, the sub-step A1* is performed. Under this circumstance, plural sealing elements (not shown) are driven to be inserted into corresponding communication holes (not shown), and the plural communication holes are closed by the plural sealing elements. Then, the gas pressure supply module 41 is turned on to provide the gas, and the gas is transferred to a master pressure pump (not shown) of the testing fixture 40. Then, plural switch elements (not shown) of the testing fixture 40 are turned on. Consequently, the gas is introduced into the inner space 20 of the stereo device 2. That is, the sub-step A2* is performed.

After a certain time period, the second gas is leaked out from the inner space 20. Since the temperature of the second gas is lower than the room temperature, a special color zone may be formed around the stereo device 2 by the leaked gas, and the special color zone may be observed by the temperature sensor 42. For example, the color of the special color zone is a cold color. That is, the sub-step B* is performed. Then, by judging whether a color of the special color zone is within a standard color range, the controlling unit 43 determines whether the stereo device 2 is qualified or not. That is, the step C* is performed. The standard color range is a green color. If the color of the special color zone observed by the temperature sensor 42 is within the standard color range, it means that the amount of gas leaked out from the inner space 20 is not too large, and thus the color of the special color zone may be within the standard color range. Under this circumstance, the controlling unit 43 judges that the stereo device 2 is qualified, and the pass test message is controlled to be shown on the display device 44. That is, the sub-step D1* is performed. On the other hand, if the color of the special color zone observed by the temperature sensor 42 is not within the standard color range, it means that the amount of gas leaked out from the inner space 20 is very large, and thus the color of the special color zone. In addition, the color of the special color zone is a cold color. That is, the color of the special color zone is within the cold color range. Under this circumstance, the controlling unit 43 judges that the stereo device 2 is unqualified, and the failed test message is controlled to be shown on the display device 44. That is, the sub-step D2* is performed. Meanwhile, the testing procedure of the stereo device 2 is completed.

In some other embodiments, the gas is a high temperature gas with a temperature higher than the room temperature. If the color of the special color zone which is formed by the gas leaked out from the stereo device and observed by the temperature sensor is not within the standard color range, the color of the special color zone observed by the temperature sensor is a warm color. That is, the color is within a warm color range. Regardless of whether the gas is the high temperature gas or the low temperature gas, the stereo device testing method of the present invention is feasible.

From the above descriptions, the present invention provides a stereo device testing method and a stereo device testing system. Firstly, the stereo device is in a sealed state. Then, a gas is inputted into an inner space of the stereo device. Then, by detecting an internal pressure value of the inner space is detected or observing whether a special color zone around the stereo device is formed according to a temperature sensing technology, a gas leakage condition of the stereo device may be realized. After the stereo device is tested, the manufacturer of the stereo device may repair the gas leakage position. Under this circumstance, since the influence of the gas leakage condition on the resonant effect is minimized, the sound quality of the stereo device is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A stereo device testing method for detecting a gas leakage condition of a stereo device, the stereo device testing method comprising steps of:

(A) fixing the stereo device, and continuously inputting a gas into an inner space of the stereo device;

(B) detecting an internal pressure value of the inner space of the stereo device after a predetermined time period; and (C) judging whether the internal pressure value is higher than or equal to a default pressure value, thereby determining whether the stereo device is qualified or not, wherein if the internal pressure value is higher than or equal to the default pressure value, the stereo device is qualified, wherein if the internal pressure value is lower than the default pressure value, the stereo device is unqualified.

2. The stereo device testing method according to claim 1, wherein the step (A) comprises sub-steps of:

(A) fixing the stereo device;

(B) stabilizing or increasing an air pressure value of the gas; and (C) continuously inputting the gas into the inner space of the stereo device.

3. The stereo device testing method according to claim 1, wherein after the step (C), the stereo device testing method further comprises a step (D) of generating a pass test message or a failed test message according to a result of comparing the internal pressure value with the default pressure value, wherein if the stereo device is qualified, the pass test message is generated, wherein if the stereo device is unqualified, the failed test message is generated.

4. The stereo device testing method according to claim 1, wherein if the stereo device is unqualified, after the step (C), the stereo device testing method further comprises steps of:

inputting an additional gas to the inner space of the stereo device, wherein a gas temperature of the additional gas is higher than a room temperature, or the gas temperature of the additional gas is lower than the room temperature; and observing a special color zone which is formed by the additional gas leaked out from the inner space according to a temperature sensing technology, and recording the special color zone as a gas leakage position of the stereo device.

5. A stereo device testing system for detecting a gas leakage condition of a stereo device, the stereo device testing system comprising:

a testing fixture, wherein the stereo device is supported and fixed on the testing fixture;

a gas pressure supply module connected with the testing fixture, wherein a gas is continuously provided from the gas pressure supply module to an inner space of the stereo device;

a gas pressure detector connected with the testing fixture, wherein an internal pressure value of the inner space is detected by the gas pressure detector; and a controlling unit connected with the gas pressure detector, wherein a default pressure value is stored in the controlling unit, wherein after a predetermined time period, the controlling unit compares the internal pressure value with the default pressure value, thereby judging whether the stereo device is qualified or not, wherein if the internal pressure value is higher than or equal to the default pressure value, the controlling unit judges that the stereo device is qualified, wherein if the internal pressure value is lower than the default pressure value, the controlling unit judges that stereo device is unqualified.

6. The stereo device testing system according to claim 5, wherein the gas pressure supply module comprises:

a gas source continuously providing the gas; and a pressure booster connected with the gas source, wherein the pressure booster stabilizes a gas pressure value of the gas or increases the gas pressure value and transfers the gas to the testing fixture.

7. The stereo device testing system according to claim 5, wherein the testing fixture comprises:

a bracket body, wherein the stereo device is supported by the bracket body;

a master pressure pump connected with the gas pressure supply module, and receiving the gas from the gas pressure supply module;

plural fixing elements disposed on the bracket body, wherein the stereo device is fixed on the bracket body by the plural fixing elements;

a sealing element disposed on the bracket body and connected with the gas pressure detector, wherein a communication hole of the stereo device is closed by the sealing element, wherein the sealing element comprises a gas inlet and a gas outlet;

a first switch element connected with the master pressure pump and the gas inlet, wherein when the first switch element is turned on, the gas inlet is opened, so that the gas from the master pressure pump is introduced into the inner space; and a second switch element connected with the gas pressure detector and the gas outlet, wherein when the second switch element is turned on, the gas outlet is opened, so that the gas within the inner space is transferred to the gas pressure detector.

8. The stereo device testing system according to claim 5, further comprising:

an additional gas pressure supply module connected with the testing fixture, wherein an additional gas is continuously provided from the additional gas pressure supply module to the inner space of the stereo device, wherein a gas temperature of the additional gas is higher than a room temperature, or the gas temperature of the additional gas is lower than the room temperature; and a temperature sensor located near the testing fixture and detecting whether there is a special color zone around the stereo device, wherein if there is the special color zone around the stereo device, the special color zone is recorded as a gas leakage position of the stereo device, wherein the special color zone is formed by the additional gas leaked out from the inner space.

9. A stereo device testing method for detecting a gas leakage condition of a stereo device, the stereo device testing method comprising steps of:

(A) fixing the stereo device, and continuously inputting a gas into an inner space of the stereo device, wherein a gas temperature of the gas is higher than a room temperature, or the gas temperature of the gas is lower than the room temperature;

(B) observing a special color zone which is formed by the gas leaked out from the inner space according to a temperature sensing technology; and (C) judging whether a color of the special color zone is within a standard color range, thereby determining whether the stereo device is qualified or not, wherein if the color of the special color zone is within the standard color range, the stereo device is qualified, wherein if the color of the special color zone is not within the standard color range, the stereo device is unqualified.

10. The stereo device testing method according to claim 9, wherein after the step (C), the stereo device testing method further comprises a step (D) of generating a pass test message or a failed test message according to a result of judging whether the color of the special color zone is within the standard color range, wherein if the stereo device is qualified, the pass test message is generated, wherein if the stereo device is unqualified, the failed test message is generated.

11. The stereo device testing method according to claim 9, wherein if the stereo device is unqualified, the stereo device testing method further comprises a step (E) of recording the special color zone as a gas leakage position of the stereo device according to a temperature sensing technology.

12. The stereo device testing method according to claim 9, wherein the gas is a high temperature gas or a low temperature gas, wherein if the gas is the high temperature gas and the color of the special color zone is not within the standard color range but within a warm color range, the stereo device is unqualified, wherein if the gas is the low temperature gas and the color of the special color zone is not within the standard color range but within a cold color range, the stereo device is unqualified.

13. A stereo device testing system for detecting a gas leakage condition of a stereo device, the stereo device testing system comprising:

a testing fixture, wherein the stereo device is supported and fixed on the testing fixture;

a gas pressure supply module connected with the testing fixture, wherein a gas is continuously provided from the gas pressure supply module to an inner space of the stereo device;

a temperature sensor located near the testing fixture and detecting whether there is a special color zone around the stereo device; and a controlling unit connected with the temperature sensor, wherein a standard color range is previously stored in the controlling unit, wherein the controlling unit judges whether a color of the special color zone is within the standard color range, thereby determining whether the stereo device is qualified or not, wherein if the color of the special color zone is within the standard color range, the controlling unit judges that the stereo device is qualified, wherein if the color of the special color zone is not within the standard color range, the controlling unit judges that the stereo device is unqualified.

14. The stereo device testing system according to claim 13, wherein if the controlling unit judges that the stereo device is unqualified, the special color zone is recorded as a gas leakage position of the stereo device by the controlling unit.

15. The stereo device testing system according to claim 13, wherein the testing fixture comprises:

a bracket body, wherein the stereo device is supported by the bracket body;

a master pressure pump connected with the gas pressure supply module, and receiving the gas from the gas pressure supply module;

plural fixing elements disposed on the bracket body, wherein the stereo device is fixed on the bracket body by the plural fixing elements;

a sealing element disposed on the bracket body and connected with a gas pressure detector, wherein a communication hole of the stereo device is closed by the sealing element, wherein the sealing element comprises a gas inlet and a gas outlet;

a first switch element connected with the master pressure pump and the gas inlet, wherein when the first switch element is turned on, the gas inlet is opened, so that the gas from the master pressure pump is introduced into the inner space; and a second switch element connected with the gas pressure detector and the gas outlet, wherein when the second switch element is turned on, the gas outlet is opened, so that the gas within the inner space is transferred to the gas pressure detector.

* * * * *